US010543136B2

(12) United States Patent
Valentino et al.

(10) Patent No.: US 10,543,136 B2
(45) Date of Patent: Jan. 28, 2020

(54) SIDE ARM EXTENSIONS AND MATTRESS ATTACHMENT COMPONENTS FOR PATIENT TRANSPORT DEVICES

(71) Applicant: Ferno-Washington, Inc., Wilmington, OH (US)

(72) Inventors: Nicholas V. Valentino, Springboro, OH (US); Brian Magill, Morrow, OH (US); Timothy Dietz, Springboro, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 14/649,260

(22) PCT Filed: Dec. 4, 2013

(86) PCT No.: PCT/US2013/073005
§ 371 (c)(1),
(2) Date: Jun. 3, 2015

(87) PCT Pub. No.: WO2014/089153
PCT Pub. Date: Jun. 12, 2014

(65) Prior Publication Data

US 2015/0305951 A1 Oct. 29, 2015

Related U.S. Application Data

(60) Provisional application No. 61/733,072, filed on Dec. 4, 2012.

(51) Int. Cl.
*A61G 1/04* (2006.01)
*A61G 7/075* (2006.01)

(52) U.S. Cl.
CPC ..... *A61G 1/04* (2013.01); *A61G 7/075* (2013.01)

(58) Field of Classification Search
CPC .... A61G 13/10; A61G 13/12; A61G 13/1205; A61G 13/125; A61G 13/1245;
(Continued)

(56) References Cited

U.S. PATENT DOCUMENTS 2,203,204 A 6/1940 Nicolai
2,204,205 A * 6/1940 Bell ..... A47C 7/543 297/113
(Continued)

FOREIGN PATENT DOCUMENTS

AU 353436 S 8/2014
AU 354706 S 8/2014
(Continued)

OTHER PUBLICATIONS

Office Action dated Nov. 13, 2015 pertaining to U.S. Appl. No. 14/245,107.
(Continued)

*Primary Examiner* — Peter M. Cuomo
*Assistant Examiner* — Ifeolu A Adeboyejo
(74) *Attorney, Agent, or Firm* — Dinsmore & Shohl, LLP

(57) ABSTRACT

Embodiments of a side arm extension for a patient transport device comprise a patient transport device engagement member configured to engage a patient transport device frame or a support frame attached to the patient transport device frame, the side arm extension further comprising a rotatable and pivotable arm rest, and a side arm motion base connecting the arm rest to the patient transport device engagement member. The side arm motion base comprises, a rotational mechanism configured to rotate the arm rest, and a swing mechanism configured to pivot outwardly from the arm rest perpendicular to a perimeter of the patient transport device frame or patient transport device support frame.

11 Claims, 21 Drawing Sheets

(58) Field of Classification Search
CPC .. A61G 13/1235; A61G 13/02; A61G 7/0507; A61G 7/075; A47C 7/54; A47C 7/543; A47C 7/546
See application file for complete search history.

(56) References Cited

U.S. PATENT DOCUMENTS 2,278,749 A * 4/1942 Todd ..... A47C 7/543 297/113
2,642,250 A * 6/1953 Kasnowich ..... A61G 13/12 108/49
3,397,912 A * 8/1968 Bush ..... A47C 1/026 297/354.12
3,544,163 A * 12/1970 Krein ..... A47C 7/543 297/403
3,612,606 A * 10/1971 Swenson ..... A47C 7/543 297/396
3,631,546 A 1/1972 Eliasson
3,880,770 A 4/1975 Chenot
3,951,452 A * 4/1976 Harder, Jr. ..... B60N 2/4606 297/411.31
4,037,871 A 7/1977 Bourgraf et al.
4,073,538 A * 2/1978 Hunter ..... A47C 7/543 248/242
4,155,588 A 5/1979 Danzinger et al.
4,186,905 A * 2/1980 Brudy ..... B60R 1/0617 16/321
4,225,183 A * 9/1980 Hanagan ..... B62J 1/28 297/243
4,270,798 A * 6/1981 Harder, Jr. ..... A47C 7/543 297/411.31
4,466,664 A * 8/1984 Kondou ..... B60N 2/4633 248/291.1
D289,992 S 5/1987 Schrager
4,682,810 A 7/1987 Zarka
4,745,647 A 5/1988 Goodwin
4,761,841 A 8/1988 Larsen
4,767,148 A 8/1988 Ferneau et al.
4,829,633 A * 5/1989 Kassner ..... E05D 11/1085 16/250
4,921,295 A 5/1990 Stollenwerk
5,015,024 A 5/1991 Bloemer
5,023,968 A 6/1991 Diehl et al.
5,039,118 A * 8/1991 Huang ..... B62B 9/20 280/47.371
5,056,805 A * 10/1991 Wang ..... B62B 9/20 280/47.36
5,062,179 A * 11/1991 Huang ..... B62B 9/20 16/436
5,069,465 A 12/1991 Stryker et al.
5,084,922 A 2/1992 Louit
5,088,136 A 2/1992 Stryker et al.
5,168,601 A * 12/1992 Liu ..... B62B 9/20 16/329
5,265,969 A * 11/1993 Chuang ..... A45B 17/00 16/329
5,431,087 A 7/1995 Kambara
5,509,159 A 4/1996 Du-Bois
5,537,700 A 7/1996 Way et al.
5,586,346 A 12/1996 Stacy et al.
5,630,428 A * 5/1997 Wallace ..... A61F 5/3761 128/845
5,720,057 A 2/1998 Duncan
5,774,914 A 7/1998 Johnson et al.
5,839,136 A 11/1998 Vance et al.
5,867,911 A * 2/1999 Yates ..... A01D 34/90 16/326
5,971,091 A 10/1999 Kamen et al.
5,996,954 A * 12/1999 Rosen ..... B60R 11/0235 248/278.1
6,311,952 B2 11/2001 Bainter
D454,319 S 3/2002 Ito
6,405,393 B2 6/2002 Megown
6,503,018 B2 * 1/2003 Hou ..... B62B 9/20 16/436
6,550,801 B1 * 4/2003 Newhard ..... B62B 7/06 280/47.371
6,565,111 B2 * 5/2003 Ageneau ..... B62B 9/20 280/647
6,578,922 B2 * 6/2003 Khedira ..... B60N 2/4606 297/115
6,654,973 B2 12/2003 Van De Heuvel et al.
6,735,794 B1 5/2004 Way et al.
6,752,462 B1 * 6/2004 Kain ..... B60N 2/2812 297/250.1
6,789,292 B2 * 9/2004 Oshima ..... G06F 1/1616 16/297
6,948,197 B1 * 9/2005 Chen ..... A47D 5/006 403/97
6,976,696 B2 12/2005 O'Krangley et al.
7,003,829 B2 2/2006 Choi et al.
7,013,510 B1 3/2006 Johnson
7,273,256 B2 * 9/2007 Jane Santamaria .. B60N 2/2821 297/256.1
7,278,338 B2 * 10/2007 Chen ..... B25B 13/461 403/92
7,389,552 B1 6/2008 Reed
7,398,571 B2 7/2008 Souke et al.
7,424,758 B2 9/2008 Broadley et al.
7,426,970 B2 9/2008 Olsen
7,540,047 B2 6/2009 Lambarth
7,568,766 B2 * 8/2009 Chen ..... B60N 2/4633 292/DIG. 37
7,617,569 B2 * 11/2009 Liao ..... B62B 3/12 16/297
7,621,003 B2 11/2009 Myers et al.
D606,910 S 12/2009 Malassigne et al.
7,631,373 B2 12/2009 Broadley et al.
7,631,575 B2 * 12/2009 Gard ..... F16C 11/10 74/530
7,637,550 B2 12/2009 Menna
7,641,211 B2 1/2010 Ivanchenko
7,685,660 B2 3/2010 Chinn
7,694,368 B2 4/2010 Lewis, Jr.
7,841,611 B2 11/2010 Ivanchenko
7,857,393 B2 * 12/2010 Cebula ..... B60N 2/4606 297/115
7,941,881 B2 5/2011 Hayes et al.
7,996,939 B2 6/2011 Benedict et al.
8,051,513 B2 11/2011 Reed et al.
8,056,950 B2 11/2011 Souke et al.
8,100,307 B2 1/2012 Chinn et al.
8,239,983 B2 8/2012 Chinn
8,240,410 B2 8/2012 Heimbrock et al.
8,439,416 B2 5/2013 Lambarth et al.
8,459,679 B2 * 6/2013 Jessie, Jr. ..... B62K 15/006 280/282
RE44,884 E 5/2014 Lambarth
8,714,612 B2 5/2014 Chinn
8,898,862 B1 * 12/2014 McGrath ..... E05D 11/1007 16/326
8,901,747 B2 12/2014 Miller et al.
9,021,634 B2 5/2015 Goto et al.
9,248,062 B2 2/2016 Valentino et al.
9,456,938 B2 10/2016 Blickensderfer et al.
9,789,020 B2 10/2017 Blickensderfer et al.
10,045,894 B2 8/2018 Magill et al.
10,098,796 B2 10/2018 Valentino et al.
10,117,794 B2 11/2018 Bourgraf et al.
10,130,528 B2 11/2018 Valentino et al.
2002/0056162 A1 5/2002 Flynn et al.
2002/0174486 A1 11/2002 Heuvel et al.
2003/0025378 A1 * 2/2003 Lin ..... A47C 1/03 297/411.35
2003/0172459 A1 9/2003 Roussy
2004/0088792 A1 5/2004 O'Krangley et al.
2004/0111798 A1 6/2004 Matunaga et al.
2005/0126835 A1 6/2005 Lenkman
2005/0283911 A1 12/2005 Roussy
2006/0017263 A1 1/2006 Chen et al.
2006/0075558 A1 4/2006 Lambarth et al.

(56) References Cited

U.S. PATENT DOCUMENTS

| | | | |
|---|---|---|---|
| 2006/0096029 | A1 | 5/2006 | Osborne et al. |
| 2006/0225203 | A1 | 10/2006 | Hosoya et al. |
| 2006/0265807 | A1 | 11/2006 | Choy et al. |
| 2007/0163044 | A1 | 7/2007 | Arnold et al. |
| 2007/0245496 | A1 | 10/2007 | Chinn |
| 2008/0028527 | A1 | 2/2008 | Lewis |
| 2008/0128571 | A1 | 6/2008 | Dostaler et al. |
| 2008/0211248 | A1 | 9/2008 | Lambarth |
| 2009/0165208 | A1 | 7/2009 | Reed et al. |
| 2009/0172883 | A1 | 7/2009 | Benedict et al. |
| 2009/0222988 | A1 | 9/2009 | Reed et al. |
| 2009/0313758 | A1 | 12/2009 | Menkedick et al. |
| 2010/0199430 | A1 | 8/2010 | Chinn |
| 2010/0306921 | A1 | 12/2010 | Kramer |
| 2011/0080016 | A1 | 4/2011 | Lambarth et al. |
| 2011/0087416 | A1 | 4/2011 | Patmore |
| 2011/0260417 | A1 | 10/2011 | Bitzer et al. |
| 2011/0265262 | A1 | 11/2011 | Di Lauro et al. |
| 2011/0266821 | A1 | 11/2011 | Goto et al. |
| 2011/0277773 | A1 | 11/2011 | Sullivan et al. |
| 2012/0275896 | A1 | 11/2012 | Magill et al. |
| 2013/0168987 | A1 | 7/2013 | Valentino et al. |
| 2014/0059768 | A1 | 3/2014 | Lemire et al. |
| 2014/0276269 | A1 | 9/2014 | Illindala |
| 2015/0216747 | A1 | 8/2015 | Valentino et al. |
| 2016/0106605 | A1 | 4/2016 | Valentino et al. |
| 2016/0128880 | A1 | 5/2016 | Blickensderfer et al. |
| 2016/0374884 | A1 | 12/2016 | Blickensderfer et al. |
| 2017/0367915 | A1 | 12/2017 | Blickensderfer et al. |

FOREIGN PATENT DOCUMENTS

| | | | |
|---|---|---|---|
| CN | 102781392 | A | 11/2012 |
| DE | 29721734 | U1 | 3/1998 |
| EP | 1698314 | B1 | 4/2010 |
| EP | 2412355 | A1 | 2/2012 |
| GB | 2351439 | A | 1/2001 |
| JP | 02011955 | | 1/1990 |
| JP | 02-200262 | | 8/1990 |
| JP | 2001197962 | A | 7/2001 |
| JP | 2002543927 | A | 12/2002 |
| NL | 8901747 | A | 2/1991 |
| WO | 0069386 | A2 | 11/2000 |
| WO | 2011088169 | A1 | 7/2011 |

OTHER PUBLICATIONS

Australian Examination Report for Registration No. 353436 dated Jul. 30, 2014.
Examination Report corresponding to Japanese Patent Application No. 2012-549057 dated Oct. 28, 2014.
Preliminary Rejection pertaining to Korean Design Application No. 30-2013-063154 dated Sep. 2, 2014.
Preliminary Rejection pertaining to Korean Design Application No. 30-2013-063155 dated Sep. 2, 2014.
Preliminary Rejection pertaining to Korean Design Application No. 30-2013-063157 dated Sep. 2, 2014.
Chinese Office Action pertaining to Application No. 201180011448.8 dated Aug. 14, 2014.
Examiner's Report pertaining to Canadian Design Patent Application No. 154348 dated May 13, 2014.
Examiner's Report pertaining to Canadian Design Patent Application No. 154349 dated May 13, 2014.
Examiner's Report pertaining to Canadian Design Patent Application No. 154350 dated May 13, 2014.
Examiner's Report pertaining to Canadian Design Patent Application No. 154351 dated May 13, 2014.
International Search Report and Written Opinion for Application No. PCT/US2013/073005 dated Apr. 28, 2014.
International Search Report and Written Opinion for Application No. PCT/US2013/051271 dated Jan. 15, 2014.
International Search Report and Written Opinion for Application No. PCT/US2011/021069 dated May 25, 2011.
Extended European Search Report for Application No. 117333348.4 dated Feb. 17, 2015.
Election/Restriction Requirement pertaining to U.S. Appl. No. 13/520,627 dated Nov. 3, 2014.
Office Action pertaining to U.S. Appl. No. 13/520,627 dated Feb. 11, 2015.
Notice of Allowance pertaining to U.S. Appl. No. 13/520,627 dated Jul. 16, 2015.
Election/Restriction pertaining to U.S. Appl. No. 29/458,151 dated May 6, 2015.
Office Action pertaining to U.S. Appl. No. 29/442,947 dated Oct. 1, 2014.
Final Rejection pertaining to U.S. Appl. No. 29/442,947 dated Apr. 22, 2015.
Notice of Allowance pertaining to U.S. Appl. No. 29/442,947 dated Jul. 16, 2015.
Australian Examination Report for Registration No. 354687 dated Oct. 2, 2014.
Notice of Allowance pertaining to U.S. Appl. No. 14/414,812 dated Aug. 4, 2015.
Chinese Office Action pertaining to Application No. 201180011448.8 dated Jun. 30, 2015.
European Patent Office Search Report dated Jun. 14, 2016 in reference to co-pending European Patent Application No. 13860406.1 filed Dec. 4, 2013.
Office Action dated Feb. 4, 2016 pertaining to Japanese Patent Application No. 2015-091551.
U.S. Non-Final Office Action dated May 26, 2017 pertaining to U.S. Appl. No. 15/036,983, 41 Pages.
Office Action pertaining to Chinese Application No. 201380070062.3, filed Dec. 4, 2013, 8 pages.
Google search: "timing belt purpose of idler pulley", Dec. 8, 2016 (2 pages) https://www.google.com/?gws_rd=ssl#q=timing+belt+purpose+of+idler+pulley.
Timing Belt Idler, Dec. 8, 2016, from Repair Pal (5 pages) http://repairpal.com/timing-belt-idler.
Tensioner from Wikipedia, Dec. 8, 2016 (4 pages) https://en.wikipedia.org/wiki/Tensioner.
"Timing Belt Tensioner", Automotive Care Wayback Machine—Internet Archive: archived from Dec. 29, 2014 http://web.archive.org/web/20141229221712/http://www.automotivecare.com/your-engine-101/belts-and-tensioners/.
Non-Final Office Action dated Jan. 31, 2017, pertaining to U.S. Appl. No. 14/770,126, 43 pages.
Non-Final Office Action dated Nov. 2, 2018, pertaining to U.S. Appl. No. 14/979,748.
Non-Final Office Action dated Dec. 4, 2018, pertaining to U.S. Appl. No. 15/972,998, filed May 7, 2018.
Japanese Office Action dated Dec. 4, 2018, pertaining to Japanese patent application No. 2015-560317.

* cited by examiner

SIDE ARM EXTENSIONS AND MATTRESS ATTACHMENT COMPONENTS FOR PATIENT TRANSPORT DEVICES

CROSS-REFERENCE TO RELATED APPLICATIONS

This application claims priority to U.S. provisional application 61/733,072 filed Dec. 4, 2012, which is incorporated by reference herein in its entirety.

SUMMARY

The present invention is generally related to emergency cots, and is specifically directed to side arm extensions for patient transport devices, such as ambulance cots, stretchers, stair chairs, and the like. Additionally, the present invention is generally directed to mattress attachment members, specifically, mattress attachment members for ambulance cots.

According to one embodiment, a side arm extension for a patient transport device is provided. The side arm extension comprises a patient transport device engagement member configured to engage a patient transport device frame or a support frame attached to the patient transport device frame, the side arm extension further comprising a rotatable and pivotable arm rest, and side arm motion base connecting the arm rest to the patient transport device engagement member. The side arm motion base comprises, a rotational mechanism configured to rotate the arm rest; and a swing mechanism configured to pivot outwardly from the arm rest perpendicular to a perimeter of the patient transport device frame or patient transport device support frame.

According to another embodiment, an ambulance cot mattress is provided. comprising a mattress having a patient support side, a cot frame coupling side opposite the patient support side, and a plurality of mattress coupling members attached to the a cot frame coupling side and configured to attach the mattress to the support frame. Each mattress coupling member comprises a rotatable insert operable to be inserted into a slot of the support frame, wherein rotation of the mattress coupling member secures the mattress coupling member to the slot of the support frame.

BRIEF DESCRIPTION OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
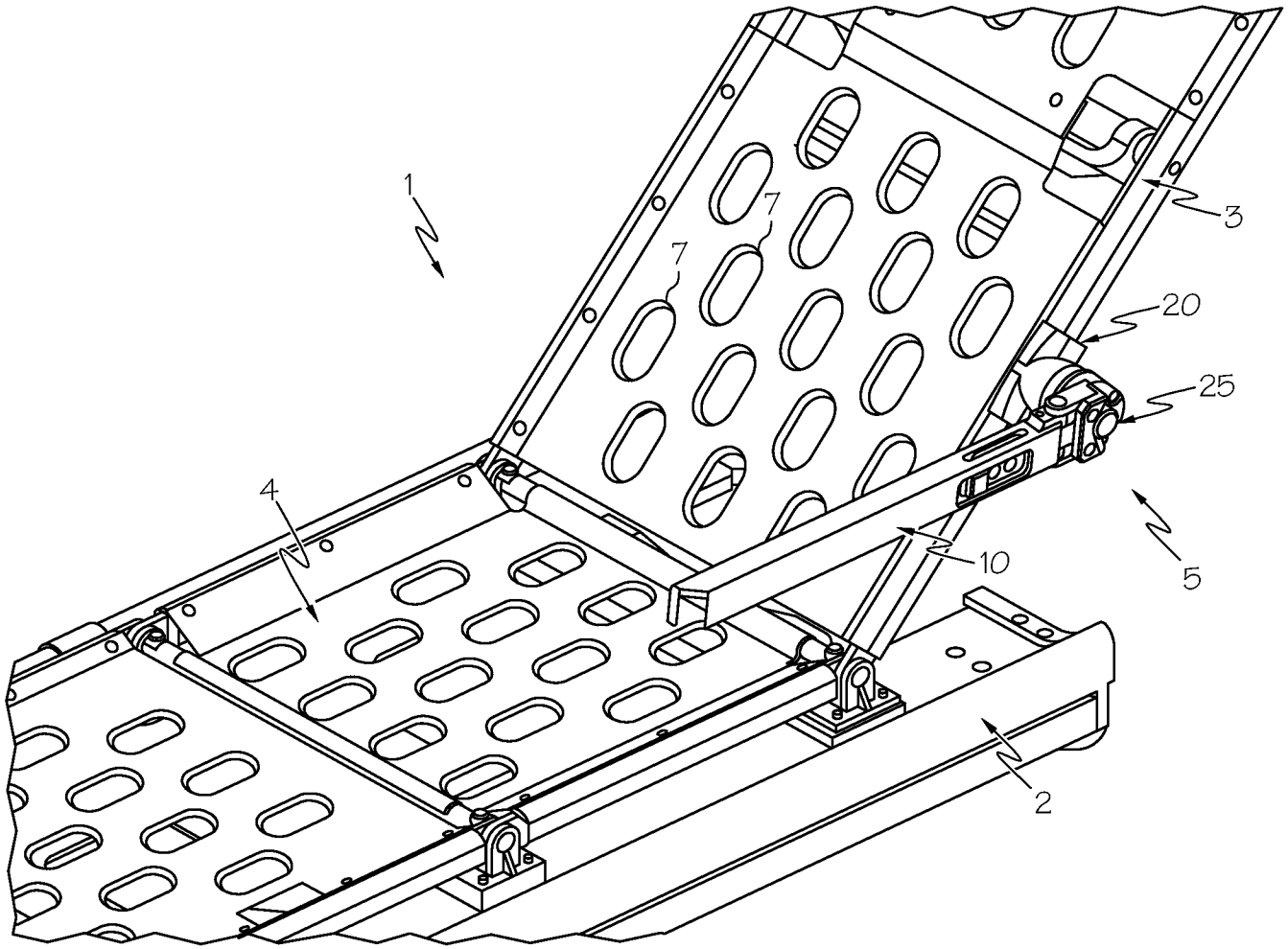
FIG. 1 is a perspective view of an ambulance cot having a side arm extension positioned substantially parallel to the lower torso section of the cot as the back rest is in an upright position according to one or more embodiments of the present invention.

Referring to FIG. 1, an ambulance cot 1 comprising side arm extensions 5 is provided. While the figures depict attachment to an ambulance cot 1, it is contemplated that any patient transport device, e.g., cot, wheel chair, stretcher, stair chair, or the like may utilize the side arm extension. The side arm extensions 5 comprise a patient transport device engagement member 20 utilized for engaging a frame 2 of a patient transport device (e.g., an ambulance cot 1) along the perimeter of the patient transport device frame (e.g., cot frame 2) or a support frame 3 attached to the cot frame. The support frame 3 is a support platform with outer rails that support a patient. The side arm extensions 5 are typically attached to rails to the support frame 3; however, it is contemplated that it could also be attached to the cot frame 2. The side arm extensions 5 also include a rotatable and pivotable arm rest 10, and a side arm motion base 25 connecting the arm rest 10 to the patient transport device engagement member 20.

Figure 7:
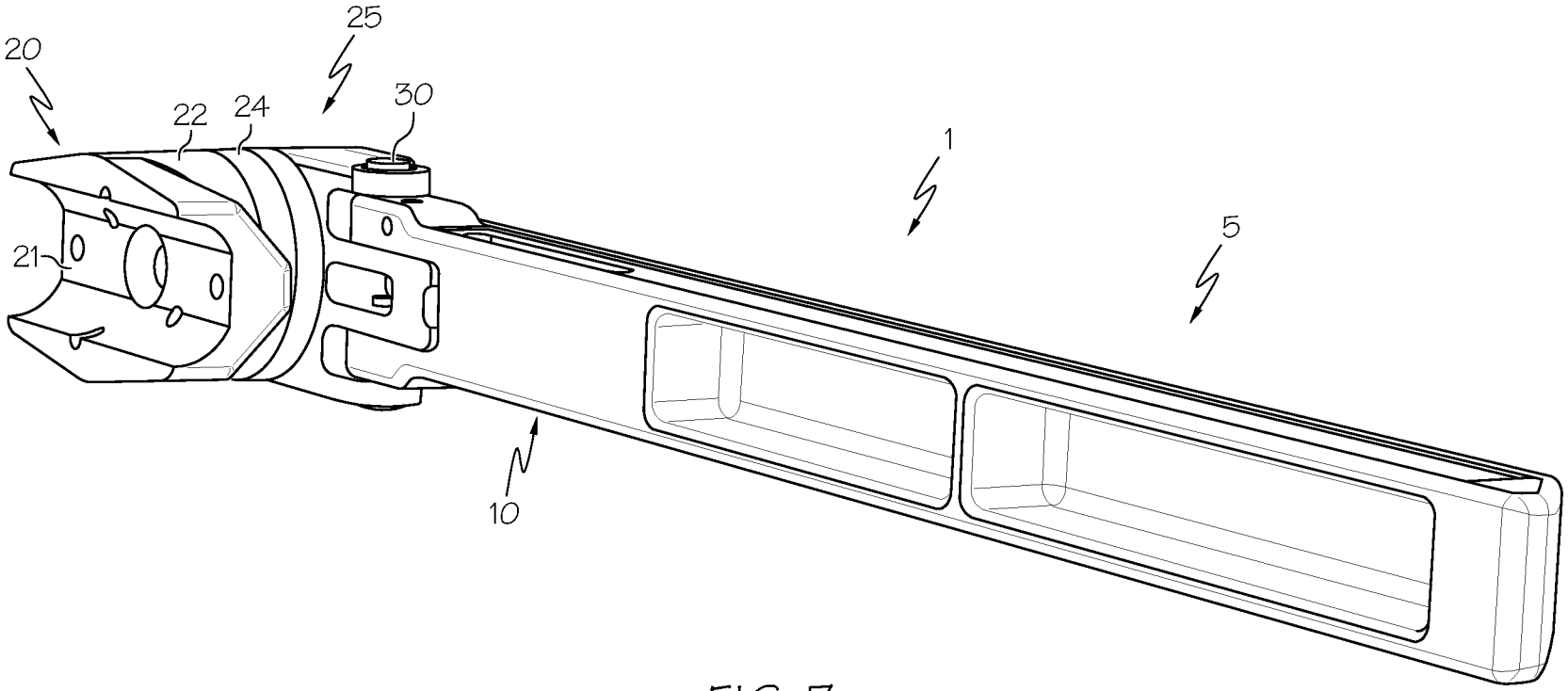
FIG. 7 is another perspective view of a side arm extension according to one or more embodiments of the present invention.
Figure 9:
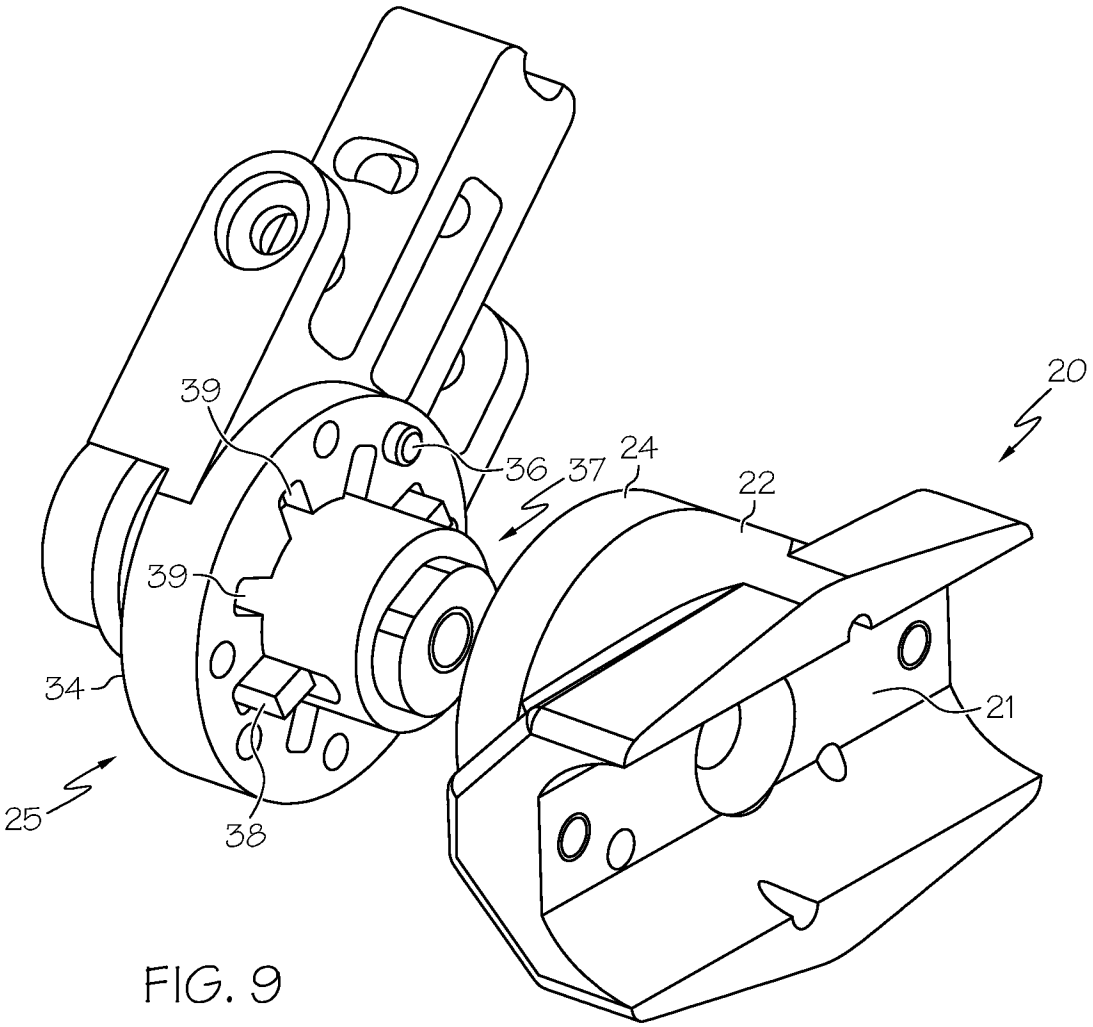
FIG. 9 is a rotated view of the internal ratchet mechanism shown in FIG. 9 according to one or more embodiments of the present invention.

As shown in the embodiment of FIG. 9, the patient transport device coupling member 20 may comprise a stationary section 22, which is coupled to the support frame 3 via a contoured surface 21, and also comprises a rotatable section 24, which attaches to and is rotatable with the side arm motion base 25. Referring to the embodiment FIG. 7, the patient transport device engagement member 20 may include a contoured surface 21 suitable for a snap attachment onto a side bar on the support frame 3 perimeter. Various coupling mechanisms are contemplated for use as the patient transport device engagement member, for example, the snap fit mentioned above. Additional fasteners (not shown) may be utilized to ensure the side extension is firmly secured to the side bar or side rail. Referring to FIG. 1, the patient transport device engagement member 20 is typically coupled to one or more side rails adjacent the back rest of the support frame 3; however, other positions are contemplated herein.

Figure 2:
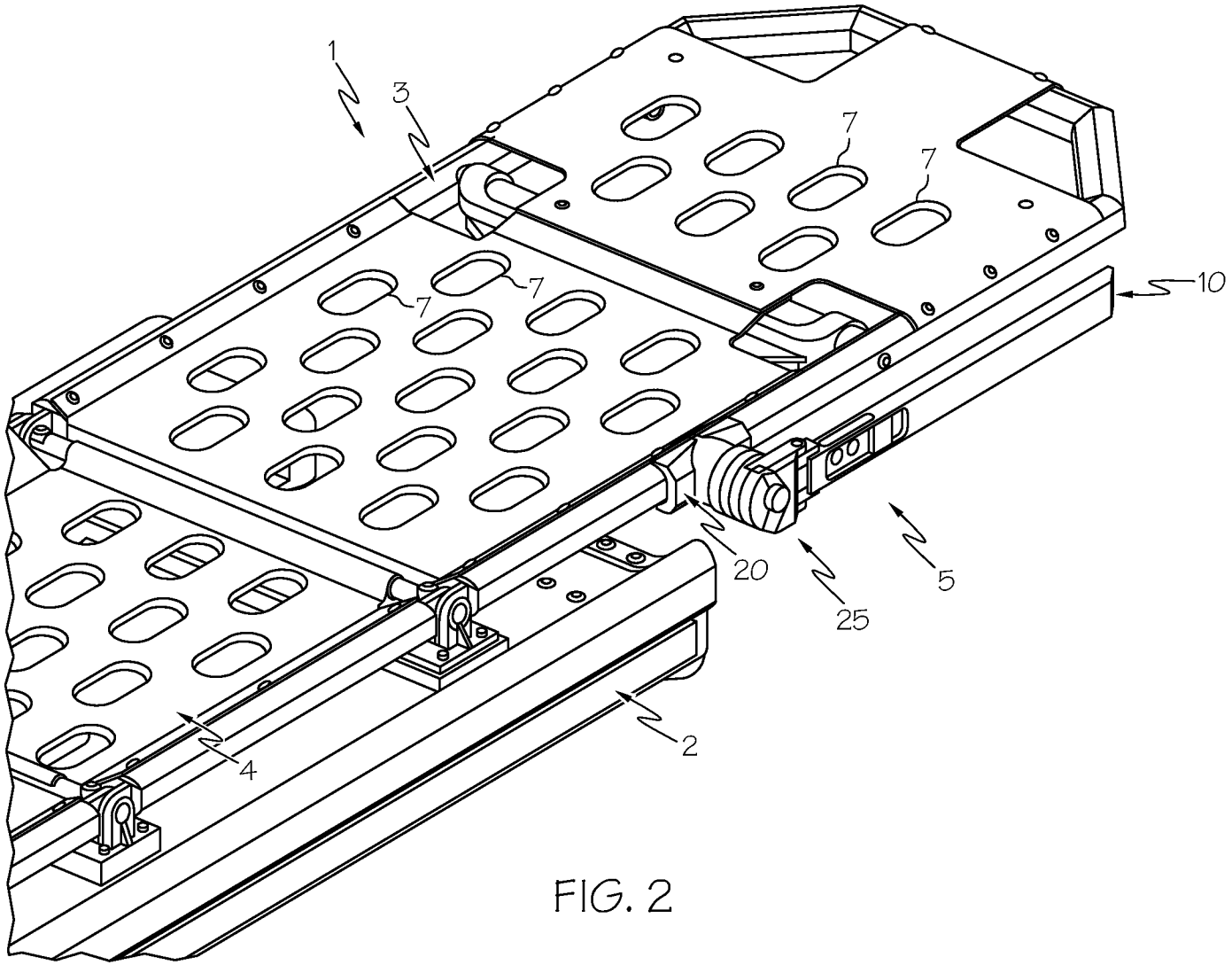
FIG. 2 is a perspective view of an ambulance cot having a side arm extension positioned substantially parallel to the lower torso section of the cot as the back rest is lowered according to one or more embodiments of the present invention.
Figure 3:
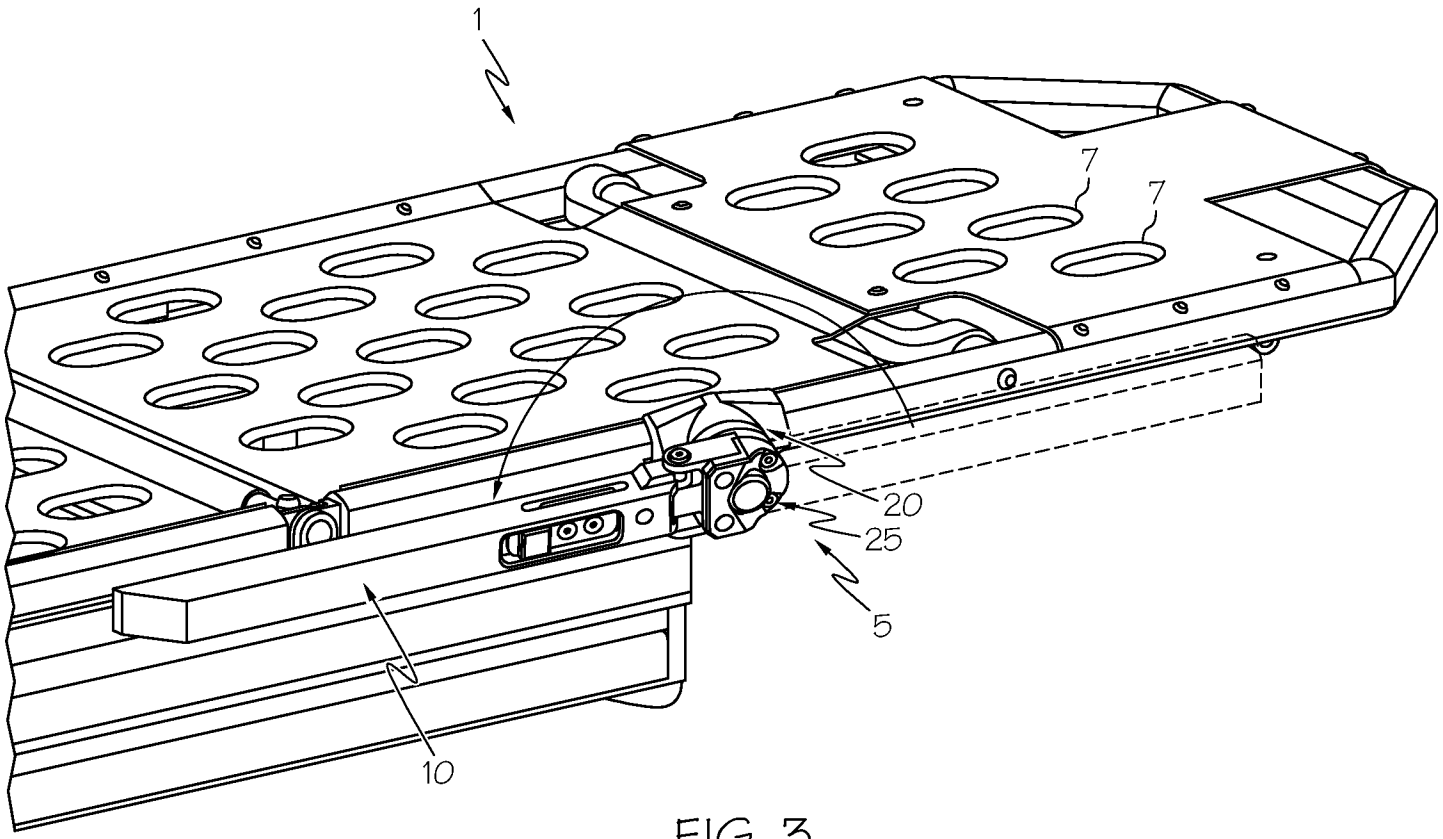
FIG. 3 is a perspective view of an ambulance cot having a side arm extension positioned substantially parallel to the lower torso section of the cot as the back rest is lowered, but rotated 180° relative to the position of FIG. 2, according to one or more embodiments of the present invention.
Figure 4:
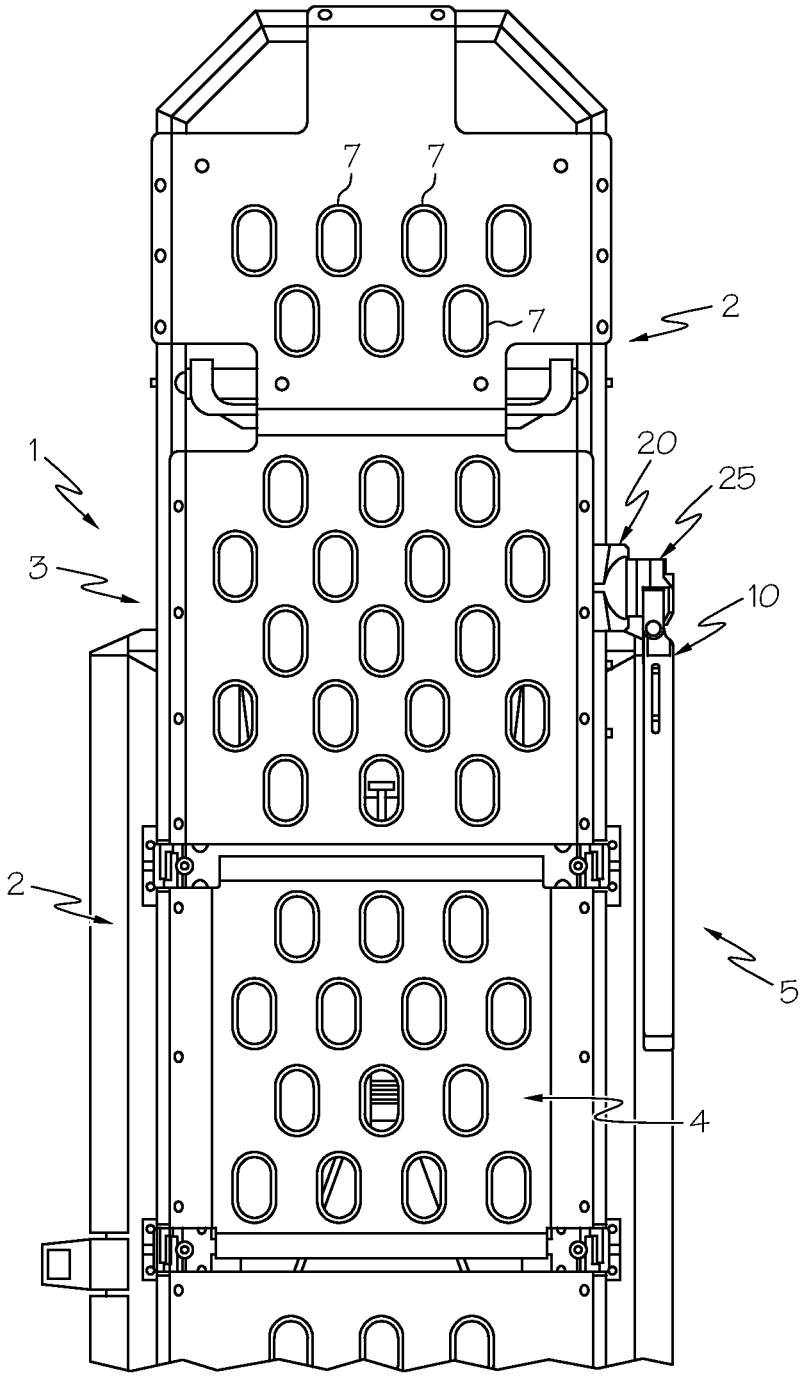
FIG. 4 is a top view of an ambulance cot having the side arm extension shown in FIG. 3, according to one or more embodiments of the present invention.
Figure 5:
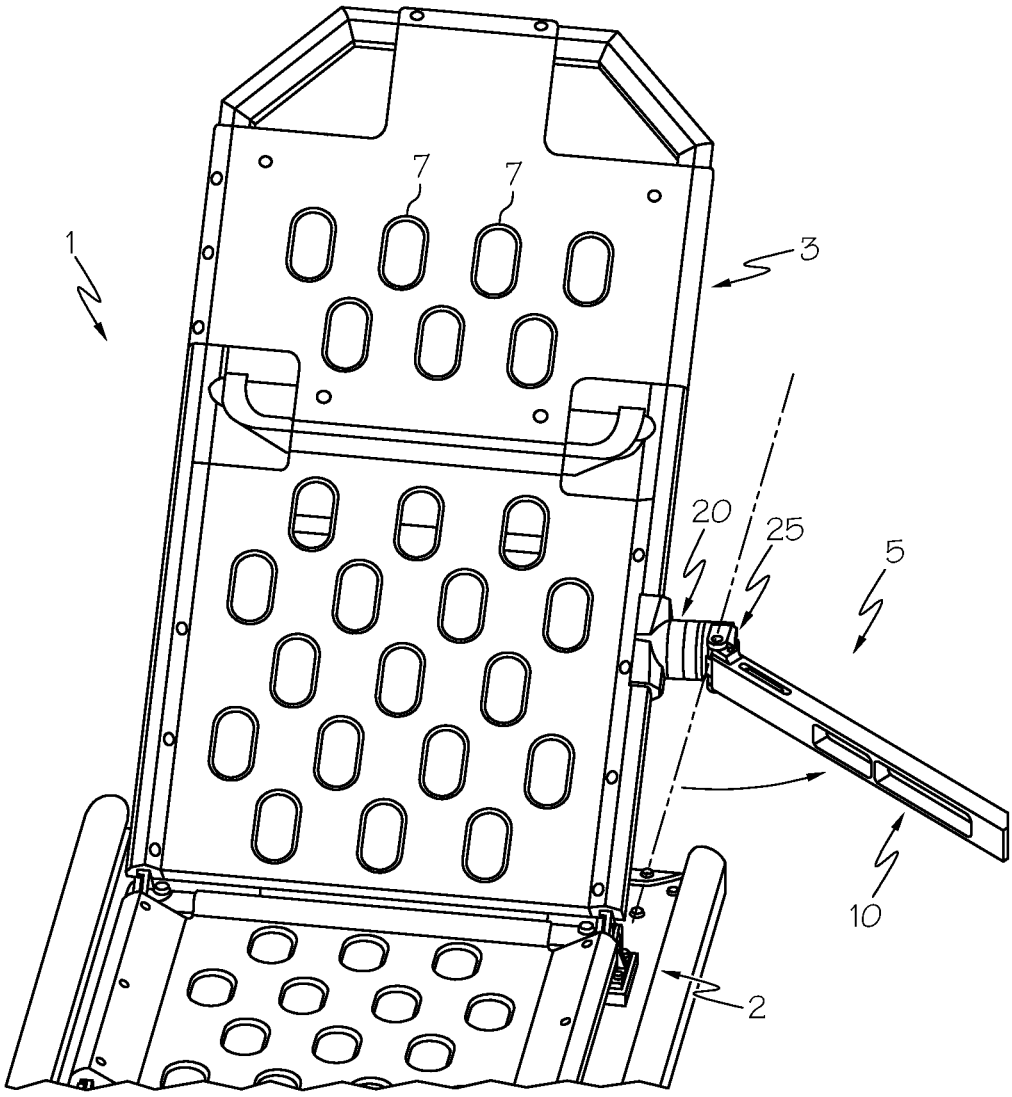
FIG. 5 is a perspective view of an ambulance cot having a side arm extension pivoted outwardly according to one or more embodiments of the present invention.

As will be detailed below, the side arm extension 5 comprises components which allow the side arm extension 5 to rotate, and pivot outwardly perpendicular to the perimeter of the support frame 3. In one configuration shown in FIG. 1, when the back rest is raised to an upright position, and the arm rest 10 may be rotated such that the lower torso section 4 of the cot 1 is horizontally parallel to the arm rest 10. Alternatively, when in a non-upright position as depicted in FIGS. 2-4 (i.e., in exemplary positions wherein the side arm extension are generally not in use), the side arm extension 5 may be rotated such that the end of the arm rest 10 is positioned near the head section of the support frame 3 (See FIG. 2) or rotated such that the end of the arm rest 10 is positioned near the lower torso section 4 of the support frame 3 (See FIGS. 3 and 4). Furthermore, as shown in FIG. 5, the arm rest 10 may pivot or swing outwardly as shown. This outward pivoting motion may be beneficial to large or obese patients, who may not easily fit in the spacing between the arm rests 10 when in a non-pivoted position.

Figure 6:
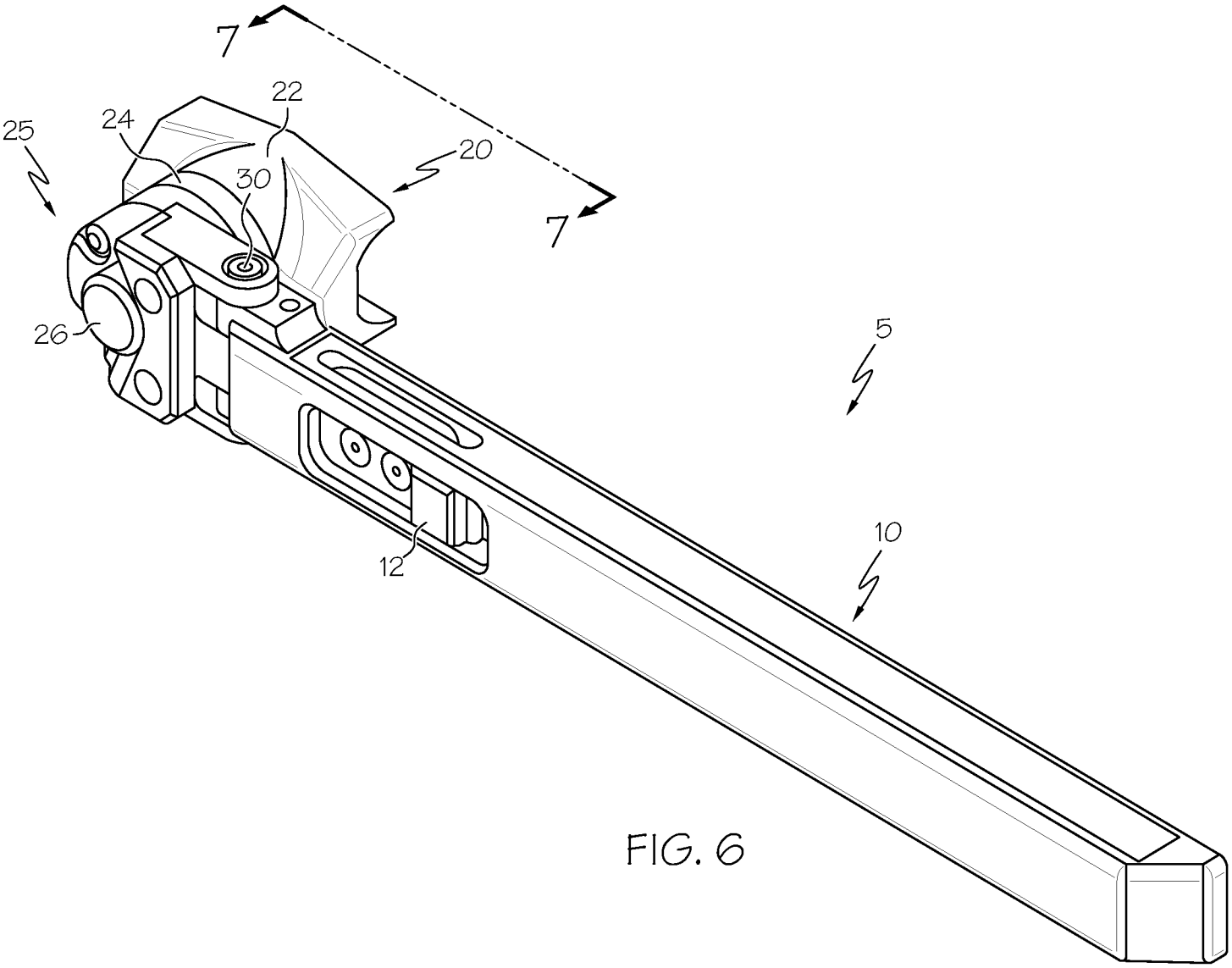
FIG. 6 is a perspective side view of a side arm extension according to one or more embodiments of the present invention.

Referring to FIGS. 6 and 9, the side arm motion base 25 includes a rotational mechanism (e.g., ratchet mechanism 37) configured to rotate the arm rest 10, and a swing mechanism configured to pivot the arm rest outwardly away from the perimeter of the cot frame perimeter. The rotational mechanism allows for up to 360° of rotational freedom, or in a specific embodiment, the rotational mechanism allows for up to 180° of rotational freedom. The swing mechanism allows for up to 90° of pivotal movement, or in a specific embodiment, up to 25° of rotation relative to the side arm motion base.

Figure 8:
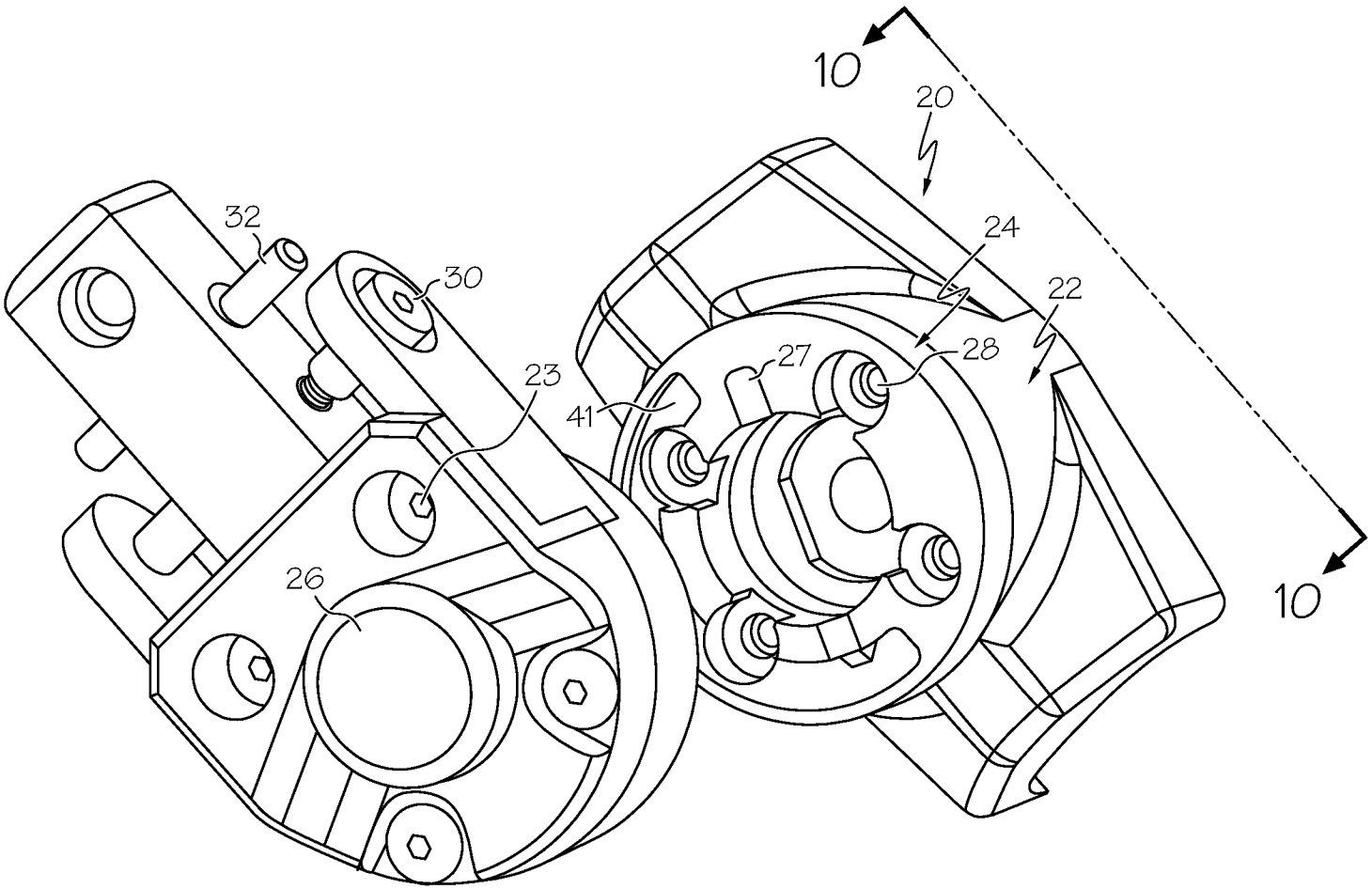
FIG. 8 depicts the internal ratchet mechanism of the arm rest of the side arm extension according to one or more embodiments of the present invention.

In one embodiment, the rotational mechanism is a ratchet device as depicted in FIGS. 8 and 9. Referring to FIGS. 8 and 9, the ratchet mechanism 37 of the side arm motion base 25 comprises at least one tab 38 which is inserted into a slot 27 of the patient transport device coupling member 20 to facilitate coupling of the patient transport device coupling member 20 to the side arm motion base 25. While only one tab is shown it is contemplated to include another tab. Optionally, a tab perpendicular to the other tab 38 may be incorporated such that the two blades form a stacking arrangement to increase the load which can be handled. Furthermore, the coupling of the patient transport device coupling member 20 to the side arm motion base 25 may also include an additional fastener. For example and not by way of limitation, the side arm motion base 25 may include a threaded bolt 23 which engages the corresponding threaded hole 28 of the patient transport device coupling member.

Additionally, to facilitate rotation of the arm rest 10, the ratchet mechanism 37 is provided with discrete positional slots 39. When the tab 38 is disengaged from the slot 27 of the patient transport device coupling member 20 by a suitable actuation mechanism (e.g., button 26), the tab 38 may move between discrete positional slots 39, which thereby facilitates rotation of the arm rest 10 to different positions. As shown in FIG. 9, the positional slots 39 define the possible rotational positions for the side arm extension 5. In one embodiment as shown in FIGS. 8 and 9, the side arm motion base 25 may also comprise a locking pin 36 to limit rotation of the arm rest 10. Specifically, the locking pin 36 of the side arm motion base 25 moves within curved slot 41. In operation, the slot 41 defines the maximum rotation of the locking pin 36, which thereby defines the maximum rotation of the side arm motion base 25 and arm rest 10 attached thereto.

Figure 10:
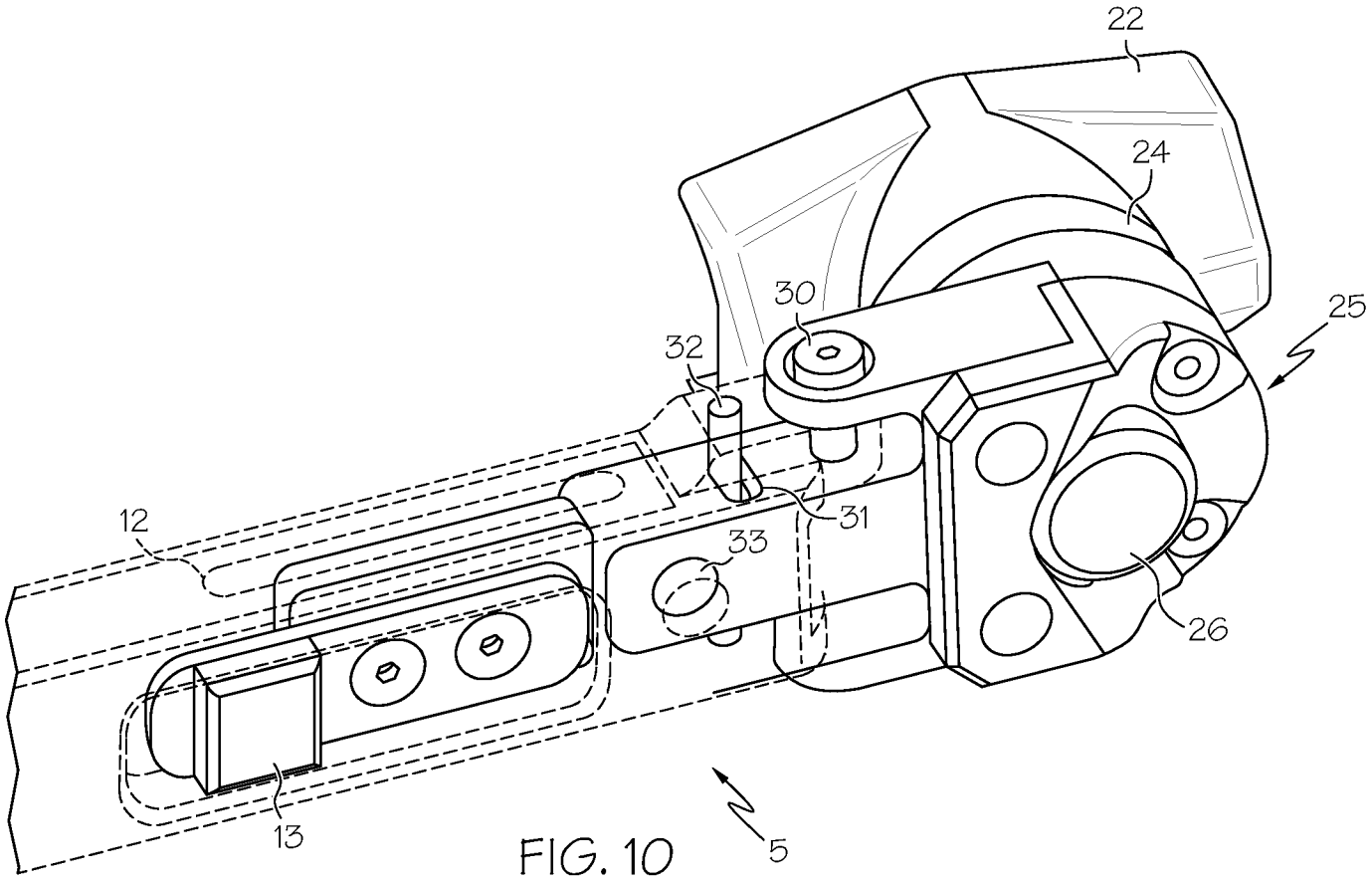
FIG. 10 is another view of the side arm extension with components shown in phantom to highlight swing/pivot features according to one or more embodiments of the present invention.
Figure 11:
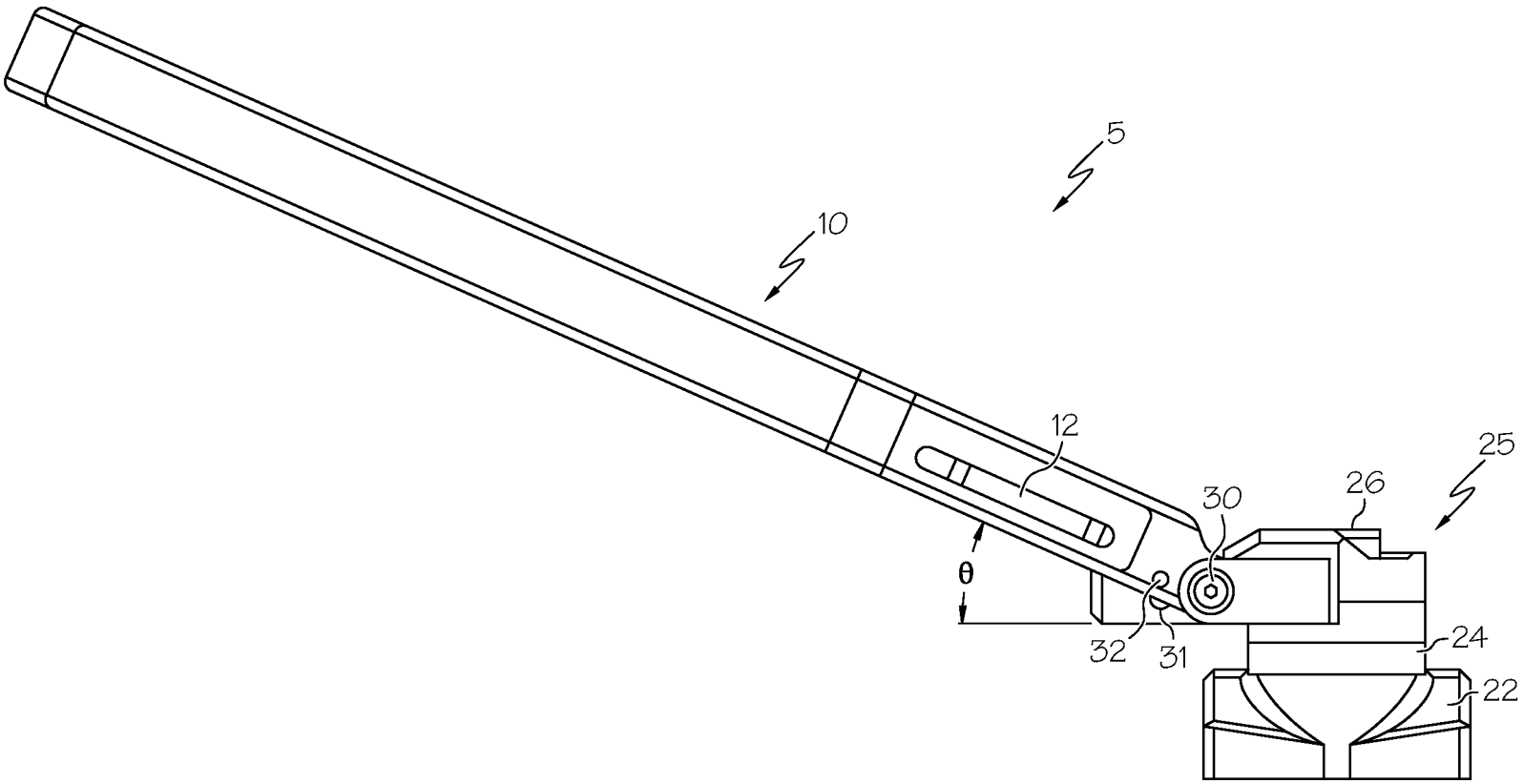
FIG. 11 is a top view of side arm extension in outwardly pivoted position according to one or more embodiments of the present invention.

Turning to the swing mechanism as shown in FIG. 10, the side arm motion base 25 comprises a stationary rod 30 which is inserted to slots of the arm rest 10. Referring to FIGS. 5 and 11, the arm rest 10 is configured to pivot about stationary rod 30 to the swinging motion of the arm rest 10. As shown in the embodiment of FIG. 10, the swing mechanism comprises an internal spring 33 which maintains the arm rest 10 in an outwardly pivoted (See FIG. 11) or unpivoted position (See FIG. 10).

Figure 12:
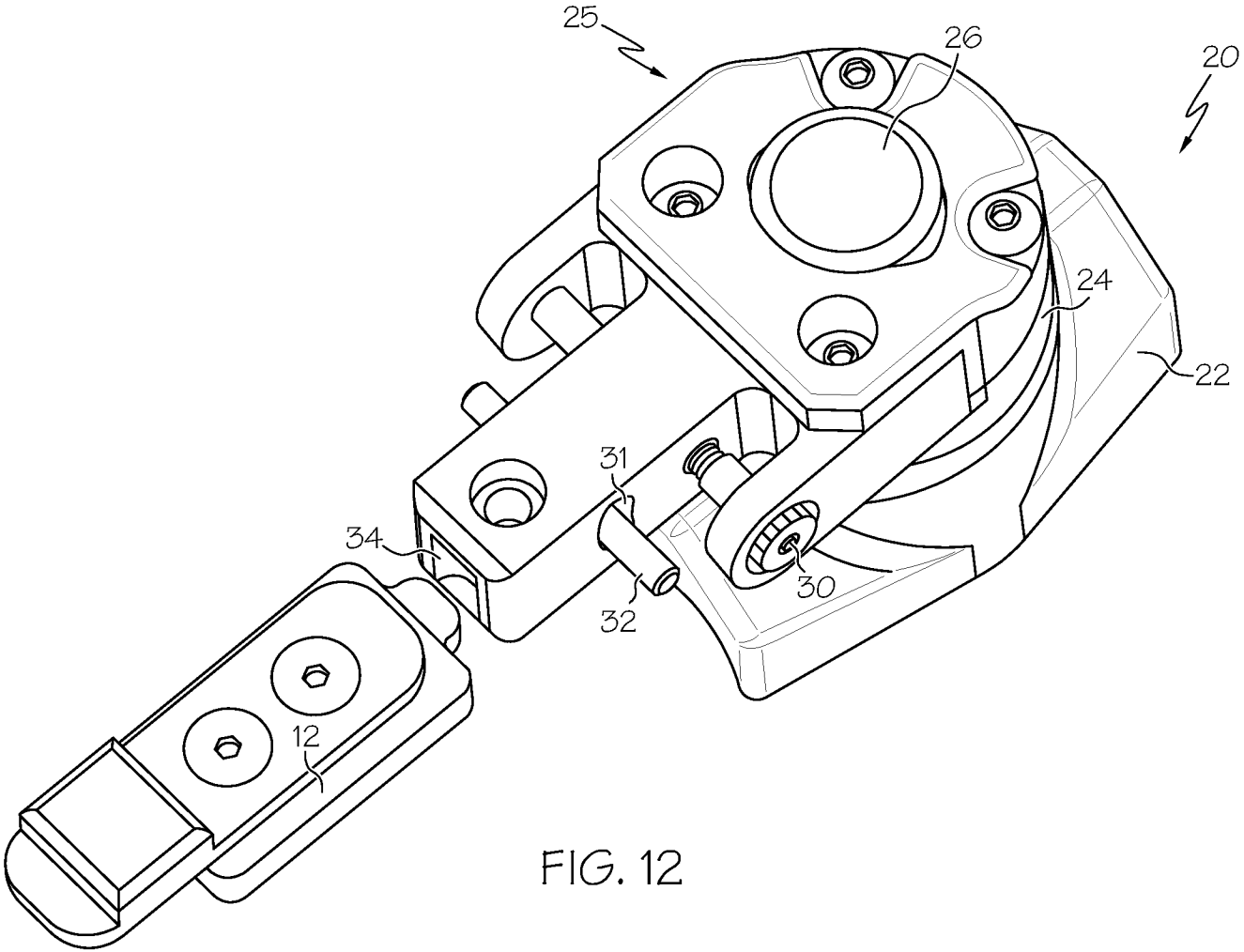
FIG. 12 depicts an internal paddle latching mechanism of the arm rest of the side arm extension in a non-pivot configuration according to one or more embodiments of the present invention.
Figure 13:
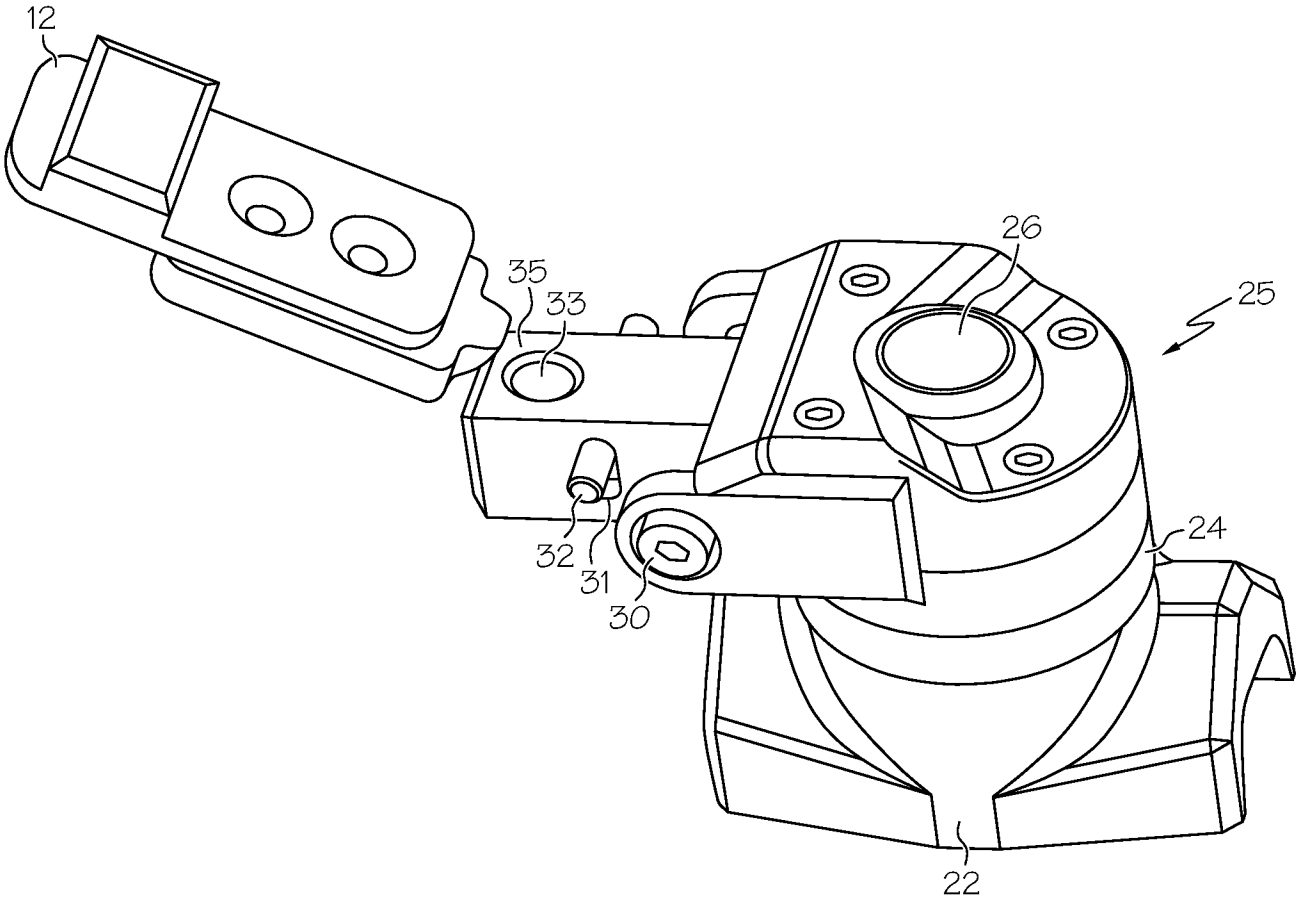
FIG. 13 depicts the internal paddle latching mechanism when the side arm extension is outwardly pivoted according to one or more embodiments of the present invention.

Referring to FIG. 12, the spring may be disengaged by a suitable actuation mechanism, for example, a paddle latch 12, which is also configured to slidingly engage a lower lip 34 of the side arm motion base 25 and thereby prevent pivoting of the arm rest 10. As shown in FIG. 10, pulling the slide lever 13 of the paddle latch 12 allows the paddle latch 12 to be slidingly disengaged to allow for pivoting of the arm rest 10. Referring to FIG. 13, after pivoting, the paddle latch 12 may engage an upper lip 35 of the side arm motion base 25 thereby securing the position of the arm rest 10 in an outwardly pivoted position.

In further embodiments, it may be desirable to reduce the radius of swinging, for example, to about 90°, or in a specific embodiment, to about 25°. Referring to FIG. 11, the arm rest 10 includes a pin 32, which is able to move within elongated slot 31 of the side arm motion base 25. The movement of the arm rest 10 is limited to the degree of movement of the pin 32 within elongated slot 31.

Figure 14:
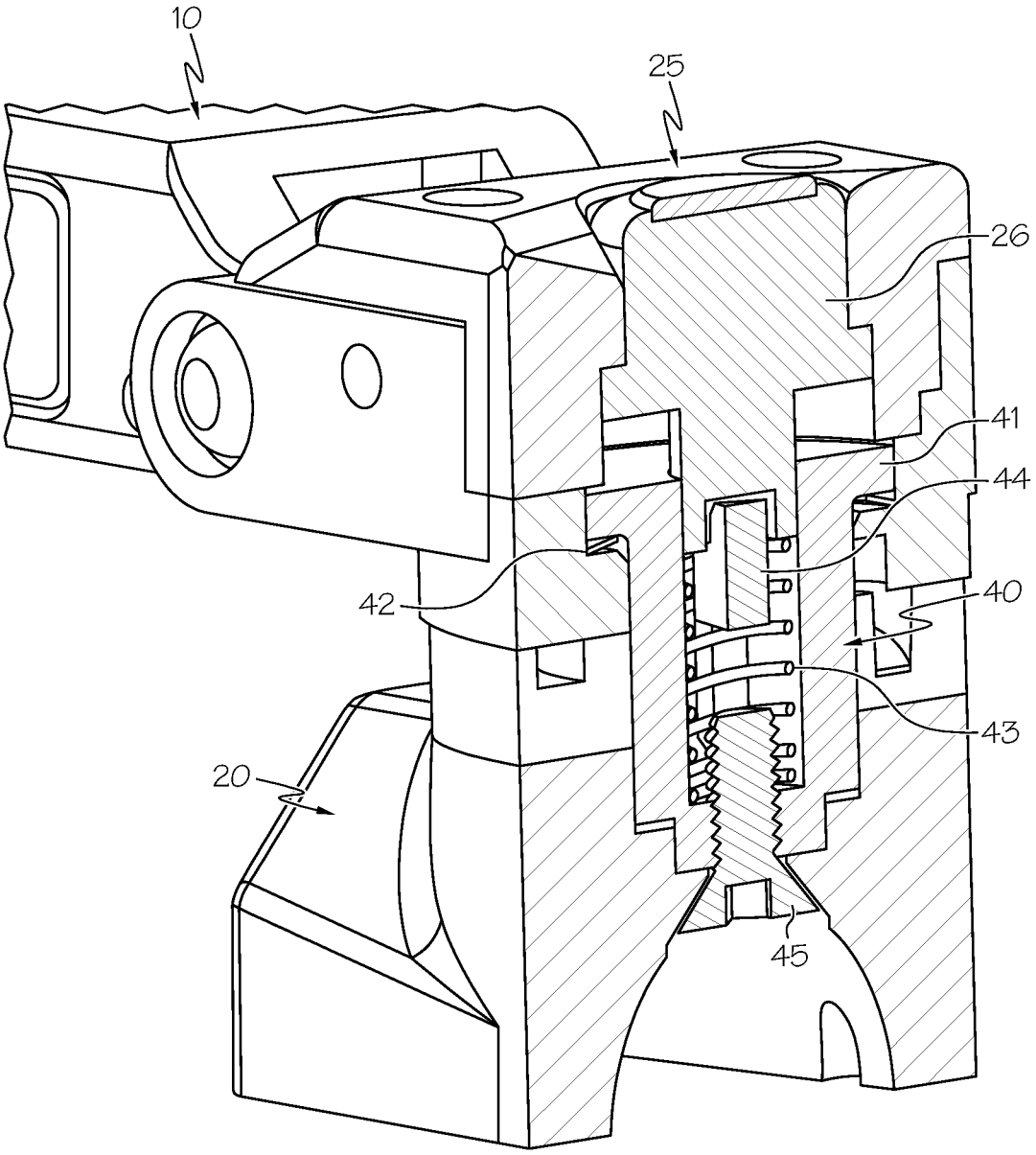
FIG. 14 depicts a cross-sectional view of the side arm extension according to one or more embodiments of the present invention.

Additionally, FIG. 14 depicts a cross-sectional view of the side arm extension 5, specifically depicting internal components that increase the durability of the side arm extensions 5. For example, the attachment of the patient transport device coupling member 20 to the side arm motion base 25 utilizes a bushing 40 with an upper flange member 41 annularly surrounding a biasing member, e.g., spring 43. The bushing 40 has a lower threaded portion to engage a screw member 45, which helps secure the patient transport device coupling member 20 to the side arm motion base 25. When the button 26 is compressed to release the arm rest 10, the button 26 may contact beam 44 which compresses spring member 43.

Further as shown in FIG. 14, although the bottom screw 45 keeps the side arm motion base 25 securely stacked on the patient transport device coupling member 20, a gap may emerge in the stack, for example, a gap underneath the upper flange member 41, thereby creating a rattling effect. To counteract the potential rattling effect, a wave washer 42 may be included underneath the flange 41 to ensure the assembly is tight.

While the above embodiments are directed to a side arm for an ambulance cot, it is further contemplated that the side arm extension could be coupled to other patient transport devices such as stair chairs, wheel chairs, stretchers, etc.

Figure 15:
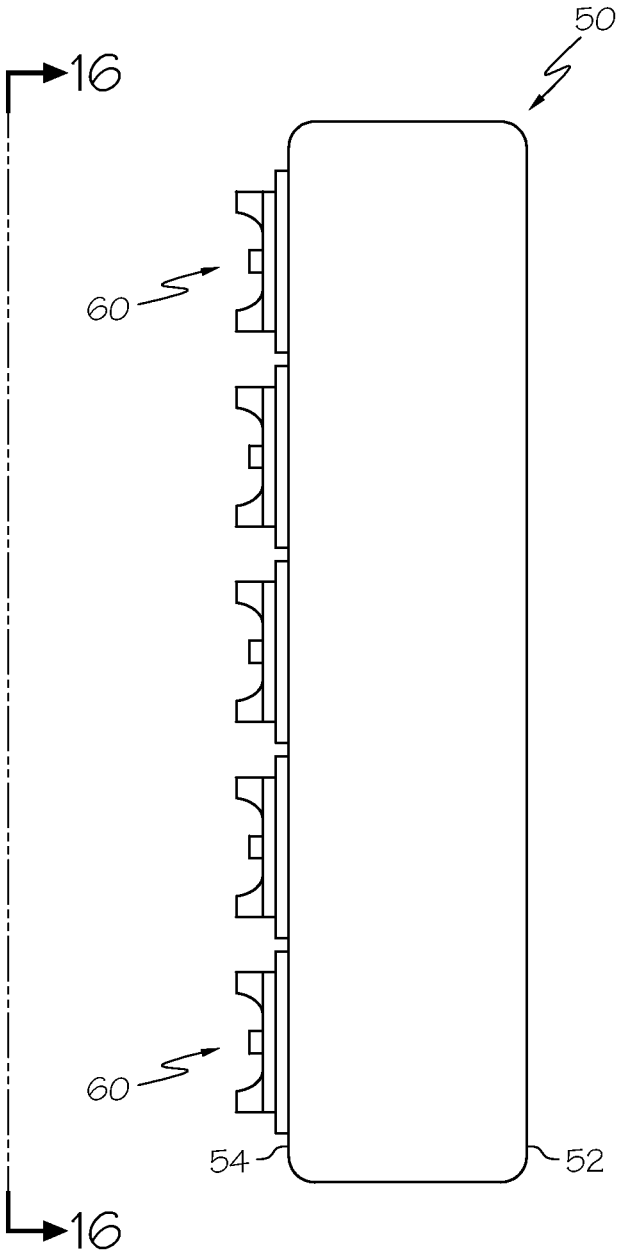
FIG. 15 is a side view of a mattress for an ambulance cot having mattress attachment members according to one or more embodiments of the present invention.
Figure 16:
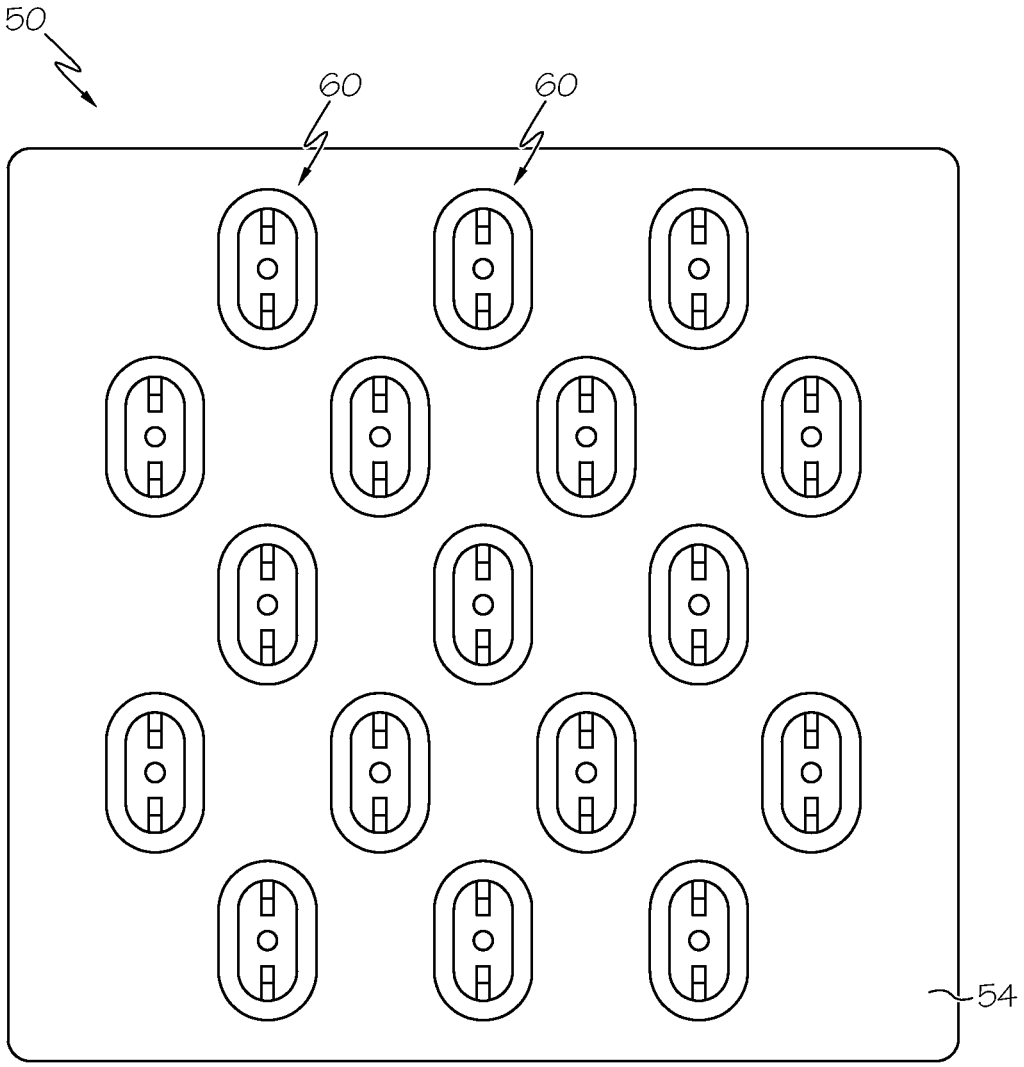
FIG. 16 is a bottom view of a mattress for an ambulance cot having mattress attachment members according to one or more embodiments of the present invention.
Figure 17:
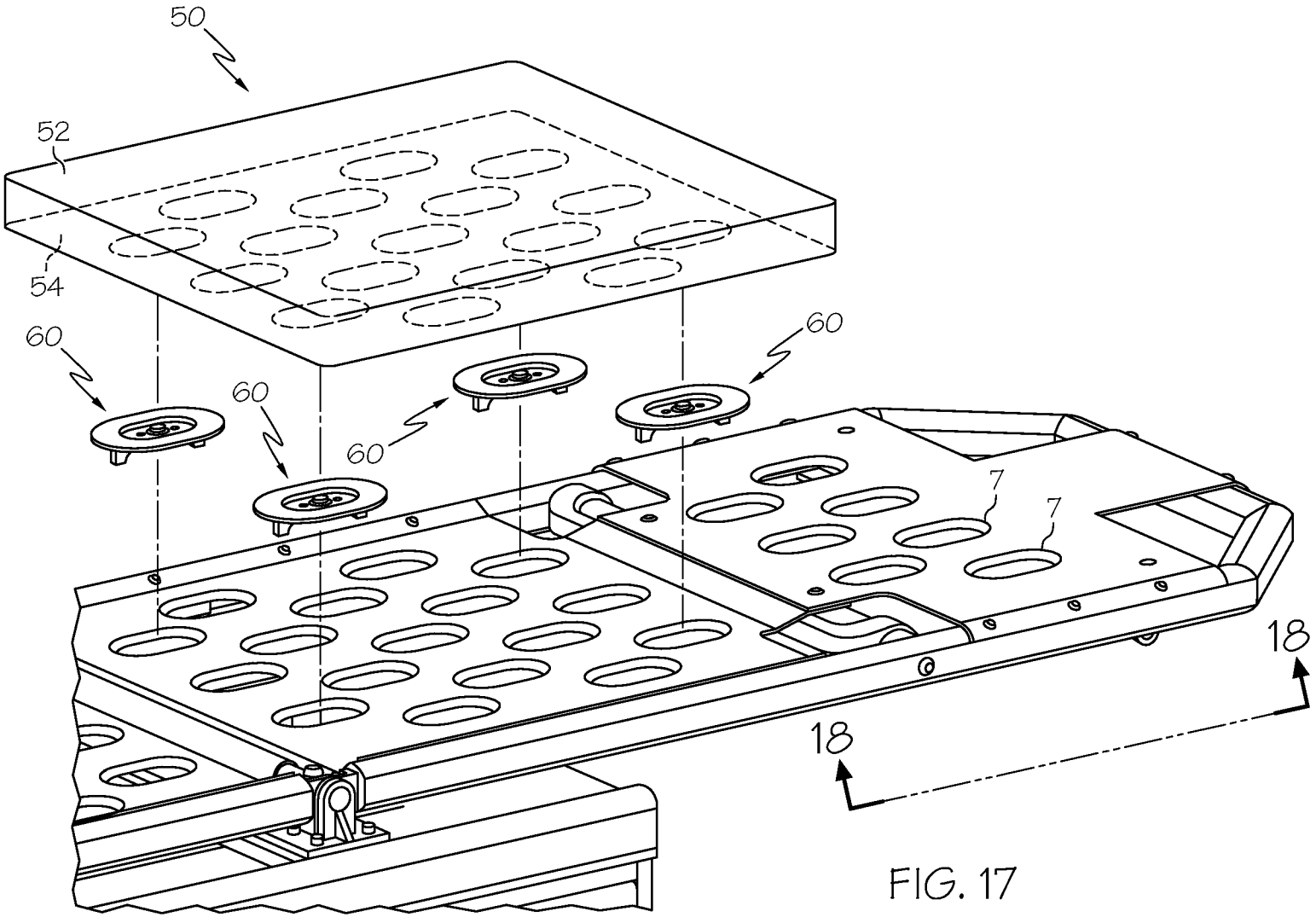
FIG. 17 is an exploded view depicting the coupling of the mattress to the backrest of an ambulance cot via the mattress attachment members according to one or more embodiments of the present invention.

The present disclosure is also directed to an ambulance cot mattress fastening component. Referring to FIGS. 15 and 17, the mattress 50 comprises a patient support side 52, a cot frame coupling side 54 opposite the patient support side 52, and a mattress coupling member 60 attached to the a cot frame coupling side 54 and configured to attach the mattress 50 to the support frame 3. Referring to FIGS. 17-21, the mattress coupling member 60 defines an outer ring 61, and a rotatable insert 62 concentrically disposed within the ring. The rotatable insert 62 is operable to be inserted into a slot 7 of the support frame 3.

Figure 18:
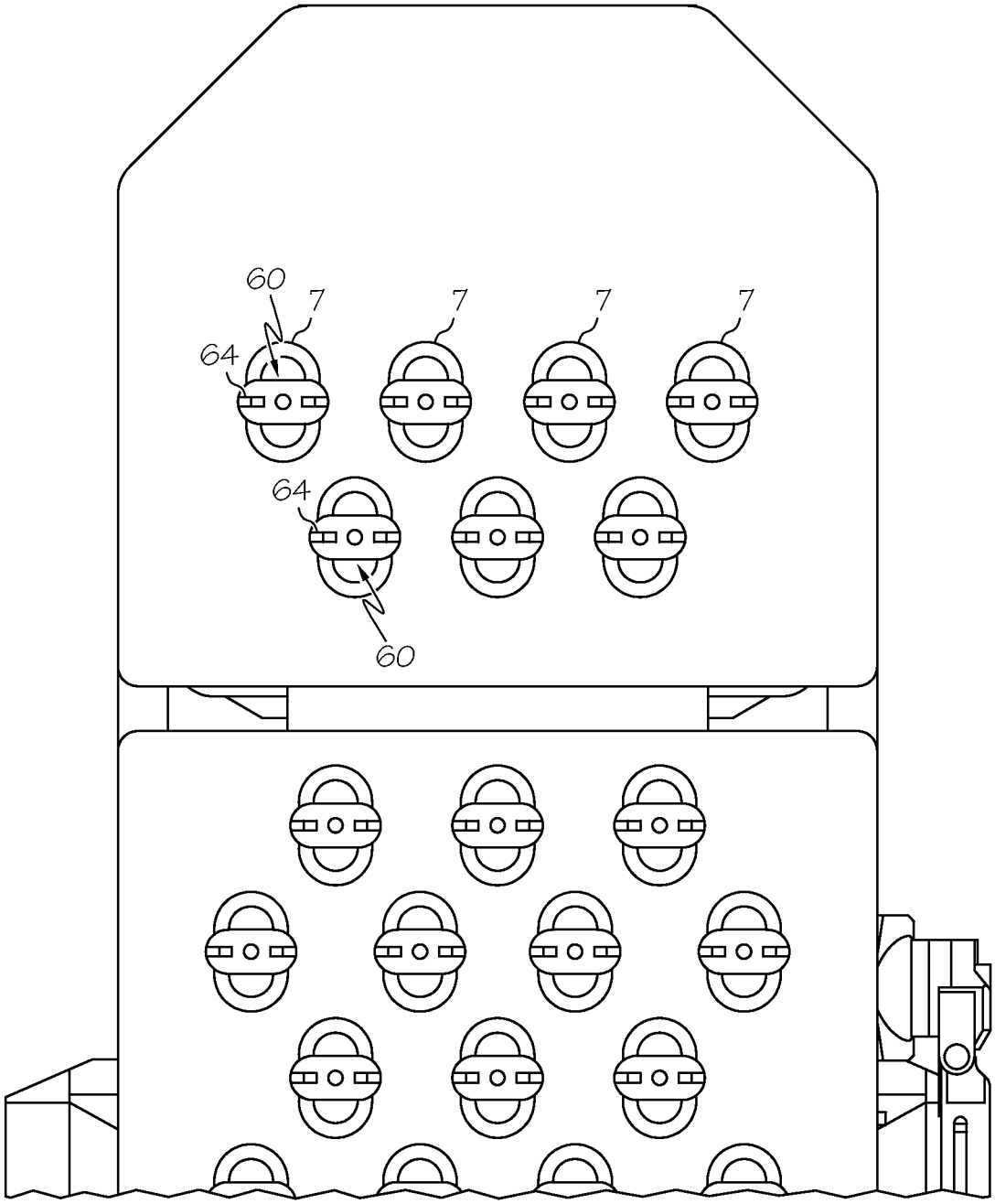
FIG. 18 is a bottom view depicting the coupling of the mattress to the backrest of an ambulance cot via the mattress attachment members according to one or more embodiments of the present invention.
Figure 19:
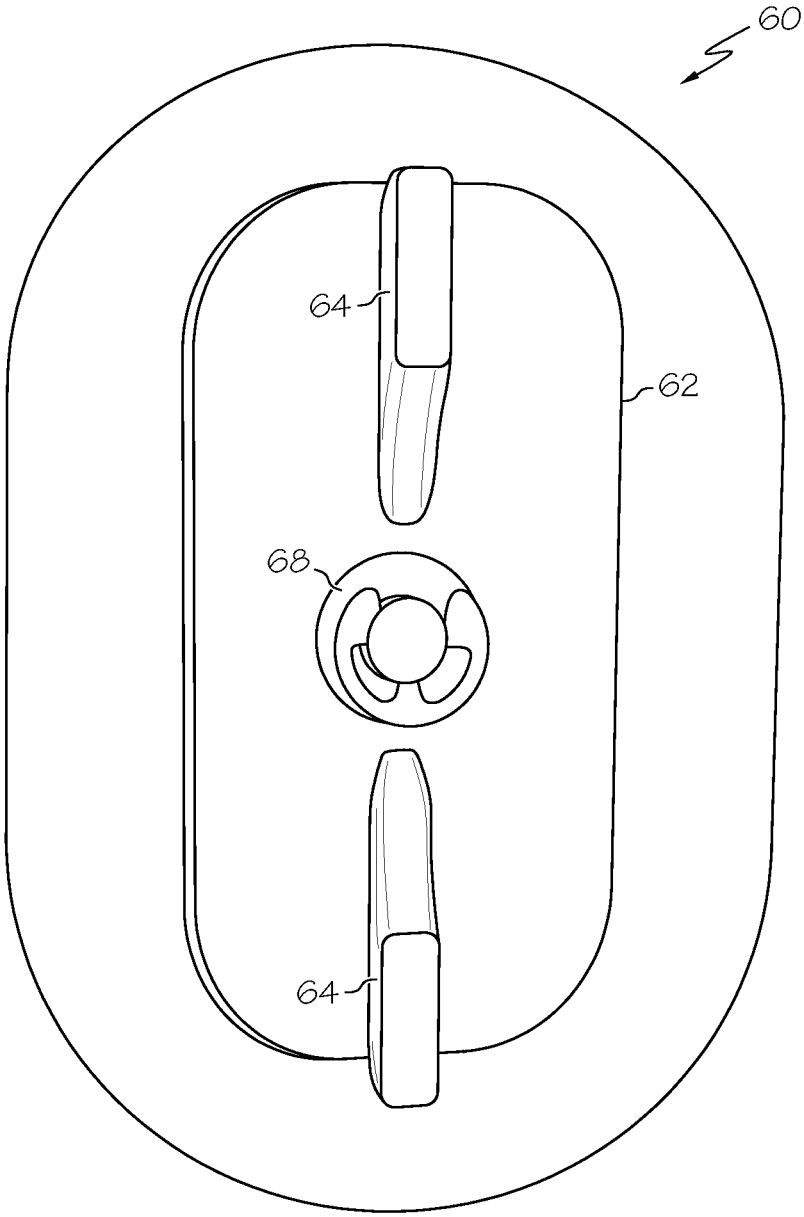
FIG. 19 depicts the cot attachment side of the mattress attachment member in nonlocking positions, wherein the mattress according to one or more embodiments of the present invention.
Figure 21:
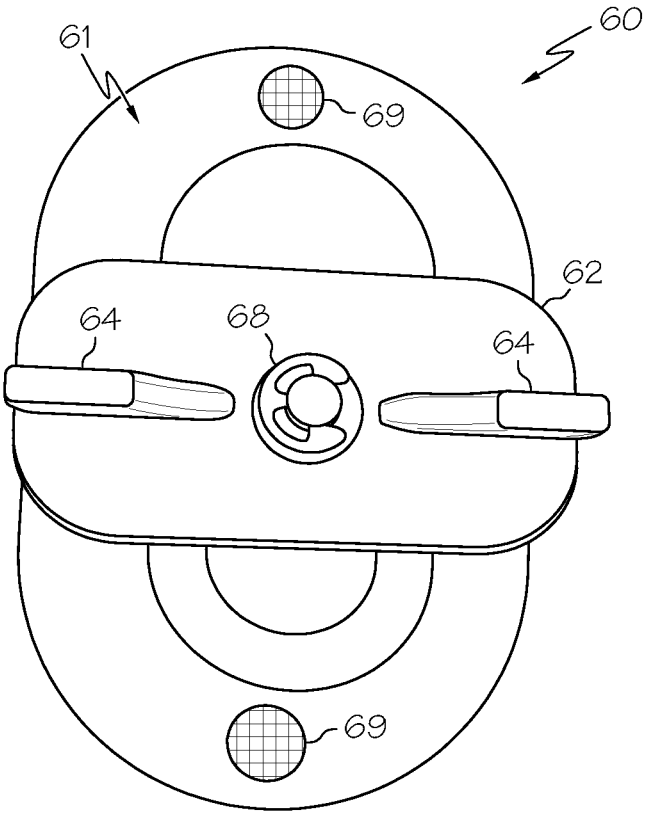
FIG. 21 depicts the cot attachment side of the mattress attachment member in the locking position according to one or more embodiments of the present invention.

Referring to FIGS. 18-19 and 21, after the rotatable insert 62 is provided in slot 7, the mattress coupling member 60 may be secured in the slot 7 by rotating flange member 64 about central pin 68. In this manner, the outer ring 61, which has a larger diameter than slot 7, will engage the top surface of the support frame 3, while the rotatable insert 62, upon rotation, engages the underneath surface of the support frame 3 (See FIG. 18). As shown, these mattress coupling members 60 are easy to secure and easy detach from the slots 7 of the support frame 3. Thus, the process of removing or changing cot mattresses 50 is simplified.

Figure 20:
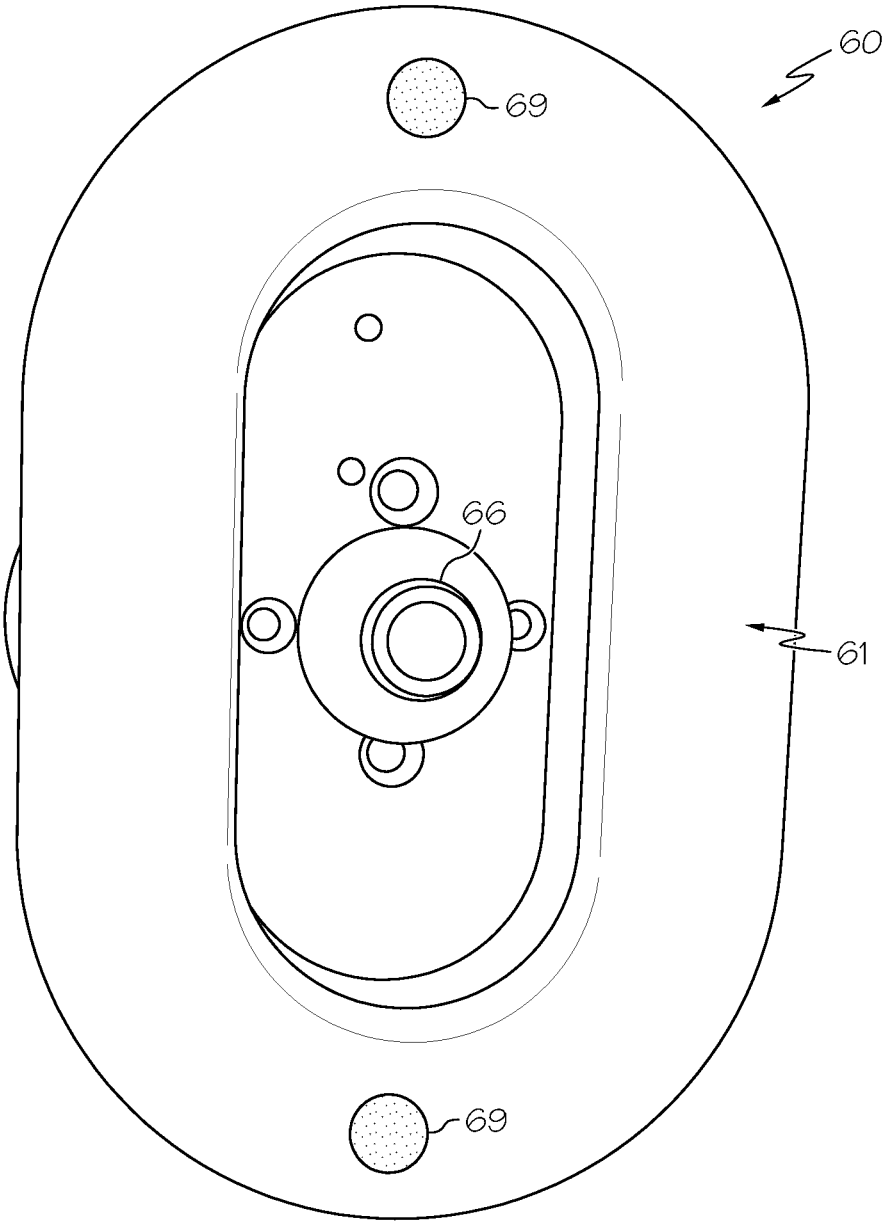
FIG. 20 depicts the mattress attachment side of the mattress attachment member according to one or more embodiments of the present invention.
Figure 22:
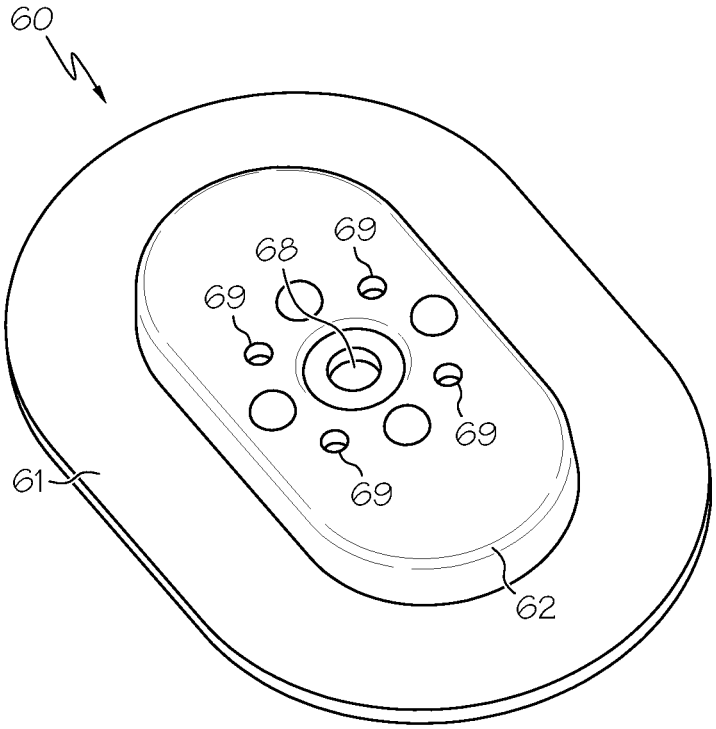
FIG. 22 depicts another mattress attachment member according to one or more embodiments of the present invention; and The embodiments set forth in the drawings are illustrative in nature and not intended to be limiting of the invention defined by the claims. Moreover, individual features of the drawings and invention will be more fully apparent and understood in view of the detailed description.

In a further embodiment as shown in FIGS. 20-22, the mattress coupling members 60 may include vents 69, which are used to release any build up of air to prevent a "ballooning" effect in the mattress 50. As shown, the vents 69 are typically located on the outer ring 61; however, it is contemplated to include the vents 69 at other locations on the mattress coupling member 60 or the mattress 50. In another embodiment, the mattress coupling members 60 may include vents 69 disposed on the rotatable insert 62.

It is further noted that terms like "preferably," "generally", "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

The invention claimed is:

1. A side arm extension for a patient transport device comprising:

a patient transport device engagement member configured to engage a patient transport device frame or a support frame attached to the patient transport device frame, the patient transport device engagement member comprising a stationary section coupled to the patient transport device frame and a rotatable section;

a rotatable and pivotable arm rest; and a side arm motion base that connects the arm rest to the rotatable section of the patient transport device engagement member to provide both rotational and pivotal movement to the arm rest relative to the patient transport device frame or the support frame, wherein the side arm motion base comprises:

a rotational mechanism coupled to the arm rest, wherein the rotational mechanism comprises a ratchet mechanism and a biasing member cooperative with one another to selectively facilitate the rotational movement of the arm rest about a first axis of rotation; and a swing mechanism coupled to the arm rest through cooperation of a pin and a slot to limit the arm rest to no more than 90° of pivotal movement, wherein the swing mechanism comprises a biasing spring and a paddle latch cooperative with one another to selectively facilitate the pivotal movement of the arm rest in one or the other of an outwardly pivoted or unpivoted condition about a second axis of rotation that is substantially orthogonal to the first axis of rotation.

2. The side arm extension of claim 1 wherein the patient transport device is an ambulance cot, a stretcher, a wheel chair, or a stair chair.

3. The side arm extension of claim 1 wherein the patient transport device is an ambulance cot.

4. The side arm extension of claim 1 wherein the rotational mechanism allows for up to 360° of rotational freedom.

5. The side arm extension of claim 1 wherein the rotational mechanism allows for up to 180° of rotational freedom.

6. The side arm extension of claim 5 wherein the swing mechanism is coupled to the arm rest to limit the arm rest to no more than about 25° of pivotal movement.

7. The side arm extension of claim 1 wherein the rotational mechanism comprises a button to disengage a tab.

8. The side arm extension of claim 1 wherein the side arm motion base comprises a stationary rod which the arm rest pivots about during swinging motion.

9. The side arm extension of claim 1 wherein the swing mechanism allows for up to 25° of pivotal movement.

10. The side arm extension of claim 1 wherein the paddle latch is configured to slidingly engage an upper lip of the side arm motion base after outward pivoting of the arm rest, thereby securing the arm rest in place.

11. The side arm extension of claim 1 wherein the cot engagement member is contoured to be snapped on a side bar on a perimeter of the patient transport device frame.

* * * * *